United States Patent [19]

Lankheet

[11] Patent Number: 5,018,324

[45] Date of Patent: May 28, 1991

[54] SWIMMING POOL WALL

[75] Inventor: Jay A. Lankheet, Holland, Mich.

[73] Assignee: Americana Pools, Holland, Mich.

[21] Appl. No.: 458,090

[22] Filed: Dec. 28, 1989

[51] Int. Cl.[5] ..... E04H 3/16; E04H 3/18

[52] U.S. Cl. ..... 52/169.7; 52/311

[58] Field of Search ..... 52/169.8, 300, 169.7, 52/311; 4/506; 160/392

[56] References Cited

U.S. PATENT DOCUMENTS

| | | | |
|---|---|---|---|
| Re. 32,181 | 6/1986 | Glonek et al. | 4/506 |
| 3,177,501 | 4/1965 | Kwake | 160/392 |
| 3,654,639 | 4/1972 | Lankheet | 4/172.19 |
| 3,839,748 | 10/1974 | Stillman | 52/300 |
| 4,044,514 | 8/1977 | Rubin et al. | 52/169.7 |
| 4,077,173 | 3/1978 | Rozanski | 52/169.8 |
| 4,205,499 | 6/1980 | Lankheet | 4/506 |
| 4,464,802 | 8/1984 | Glonek et al. | 4/506 |
| 4,781,000 | 11/1988 | Bertsch et al. | 52/169.8 |

FOREIGN PATENT DOCUMENTS

| | | | |
|---|---|---|---|
| 2171599 | 9/1986 | United Kingdom | 52/169.7 |

*Primary Examiner*—James L. Ridgill, Jr.

*Attorney, Agent, or Firm*—Price, Heneveld, Cooper, DeWitt & Litton

[57] ABSTRACT

A prefabricated panel for use in assembling swimming pools of the type employing a flexible liner for containing the water. The panel has a reinforcing frame on the back with pivotally mounted deck support members which can be moved out to support a deck on the swimming pool. A plurality of panels can be joined together in a closed configuration forming the sides of the swimming pool and with the bounded area forming the bottom. The pool liner is held along its top edge by a pool liner bead holder fastened along the edge of the assembled panels.

A decorative tile holder is supported about the upper edge of the swimming pool by the pool liner bead holder. The lower edge of the decorative tile holder is held against the side of the pool by a second pool liner bead which is inserted into and held by a channel along the lower edge of the decorative tile holder. The second pool liner bead depends from a flap of material on the pool liner and prevents water from moving behind the decorative tile holder. A complete swimming pool is also disclosed.

32 Claims, 3 Drawing Sheets

SWIMMING POOL WALL

BACKGROUND OF THE INVENTION

At the present time, in-ground swimming pools are generally made through either of two techniques. In the first technique a large hole is excavated in the ground where the swimming pool is desired. The hole is then lined with reinforcing rods and wire and a cement mixture is forced into the reinforcing structure to form the in-ground swimming pool. The top edge of the in-ground pool is usually covered with tile to enhance the overall appearance of the pool. After the pool is completed, a cement deck is usually laid around it to help keep the water clean. This is a very expensive construction technique.

In the second technique, a hole is excavated for the pool and a ledge is formed about two to four feet down from the top of the excavation. The ledge is lined with panels of fiberglass reinforced plastic, structural foam plastic, wood or metal which are joined together and then braced. Stakes are shipped separately from the pool walls and are secured to the pool walls on the job site. They extend perpendicularly away from the walls and have some type of stake receiving anchor at an end remote from the wall. A stake is driven into the ground, through the stake receiving anchor. The wall is usually aligned and the brace and anchor then fixed against relative movement. The walls are then back filled around the bracing. A flexible liner, usually of a vinyl plastic, is then drawn across the pool area confined within the walls. A concrete apron or wooden deck is then assembled around the top edge of the pool walls, extending away from the pool walls over the back fill area.

In an attempt to improve the appearance of the finished flexible lined pools, tile patterns have been printed on the pool liner. While this has an attractive appearance, it is not the same as having actual tile pieces mounted about the edge of the pool. In an attempt to accomplish the latter, U.S. Pat. No. 3,628,198, issued Dec. 21, 1971, to Katzman disclosed a panel which could be snap-fitted into a recess along the top edge of the swimming pool. The panel hung down into the water and substantially improved the appearance of the pool. A serious problem was found, however, in that motion in the pool caused the water to rise behind the panel causing it to flap or swing out away from the wall. This obviously presented a problem in that people going in and out of the pool had to be concerned about the decorative panel and the decorative panel itself was object to failure due to the uncontrolled motion. Children often played with the loose panels and occasionally pulled them free breaking the decorative tiles. The panel also tended to stick out into the pool where it passed over high spots on the inner wall. Also, dirt and algae tended to collect behind the decorative tile panel and extend down onto the pool wall below the tile panel.

SUMMARY OF THE INVENTION

In accordance with the present invention, liner pool walls have a reinforcing deck supporting framework pivotally attached to the rear surface thereof which can be swung out and secured to the ground with ground support stakes. The deck supporting framework serves not only to reinforce the wall but also to provide a footing or support for a deck about the swimming pool.

In another aspect of the present invention, a flexible pool liner secured to the top of the pool walls includes a short, flexible flap of material extending from the pool liner a short distance from the top edge thereof. A decorative trim panel is secured to the top of the pool wall and hangs down over the upper portion of the liner. Means are provided for securing the edge of the flap to the lower portion of the trim panel to hold it in place and prevent water, dirt and algae from getting into the space behind it.

DETAILED DESCRIPTION OF THE PREFERRED EMBODIMENTS

Figure 1:
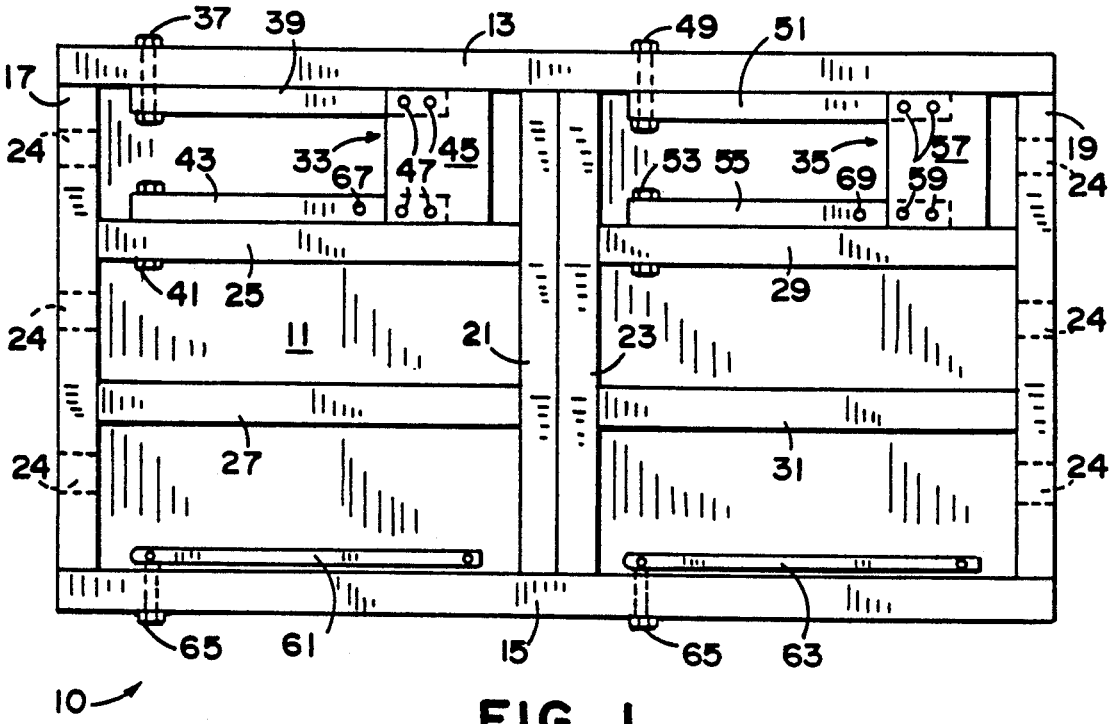
FIG. 1 is an elevational view of the reinforced side of a swimming pool panel.

Referring to FIG. 1, a swimming pool wall panel is shown and indicated generally by the number 10. The panel has a flat rectangular panel 11 which is smooth on one side to protect the pool liner from damage. However, on the side shown the panel 11 has a reinforcing framework. The panels can be made of metal, glass fiber reinforced plastic, structural foam plastic or of wood with marine plywood being the preferred material. The panel has a reinforcing frame about the edges thereof made up of a top horizontal member 13 and a lower horizontal member 15 which contacts the ground. At each end of the panel are vertical reinforcing members 17 and 19, respectively. Substantially centrally disposed on the panel are a pair of vertical reinforcing members 21 and 23. To strengthen the open sections of the panel, horizontal reinforcing members 25 and 27 are positioned between vertical reinforcing members 17 and 21 on the left while horizontal members 29 and 31 are positioned between vertical reinforcing members 19 and 23. Apertures 24 are provided in vertical members 17 and 19 to enable adjacent panels to be fastened together by suitable fasteners. It can be seen from an examination of FIG. 1 that a substantial reinforcing frame is applied to the back of the panel 11. A heavy frame is desirable to withstand the pressure applied by the water in the filled swimming pool.

The panel members 10 can be made in different sizes to allow the formation of square, rectangular and polygonal shaped swimming pools. Curved panels can be used to form round or oval pools, or to provide rounded corners on rectangular or polygonal pools. For example, the panels can be 8 or 10 feet long and 4 or 5 feet high, depending on the height of the vertical wall desired in the completed swimming pool. The panel 11 can be made of marine grade plywood to withstand decomposition due to moisture. The panel 11 can be from ¼ to ¾ inch thick, for example, depending on the amount of unreinforced area on the panel. The reinforcing frame can be made from 2×4's or preferably by 2×3 wood treated so as not to rot when wet or buried in the ground.

Each swimming pool wall panel preferably has at least one pivotally attached combined brace and deck support member. The panel shown in FIG. 1 has two deck supports 33 and 35. The deck support member 33 is pivotally attached to the horizontal reinforcing frame 13 by a suitable fastener such as a nut and bolt 37 which joins the top member 39 of the deck support to the bottom of the horizontal reinforcing frame member 13. A similar nut and bolt 41 connect the lower deck support member 43 to the horizontal reinforcing frame member 25. The free ends of the deck support members 39 and 43 are joined together by at least one gusset plate 45 which can be fastened to the deck members using suitable fasteners 47, such as nuts and bolts or brass or other hardware which, will not deteriorate when wet or buried in the ground. The deck support 35 to the right in FIG. 1 is substantially identical to the support shown to the left. It is fastened to the top horizontal reinforcing member 13 by a suitable fastener, such as a nut and bolt 49, which passes through upper deck support member 51 and a similar fastener 53 which passes through lower deck support member 55. The free ends of the deck support members 51 and 55 are joined together by at least one gusset plate 57 which is fastened to the deck support member by suitable fasteners 59, such as nuts and bolts or screws of a type that will not decompose when wet or buried in the ground. At the bottom of the pool wall panel a pair of pivotally mounted steel braces 61 and 63 are pivotally joined to the bottom reinforcing frame member 15, by a suitable fastener such as a bolt 65. The steel reinforcing braces fasten to apertures 67 and 69 in each of the lower deck support members.

Figure 2:
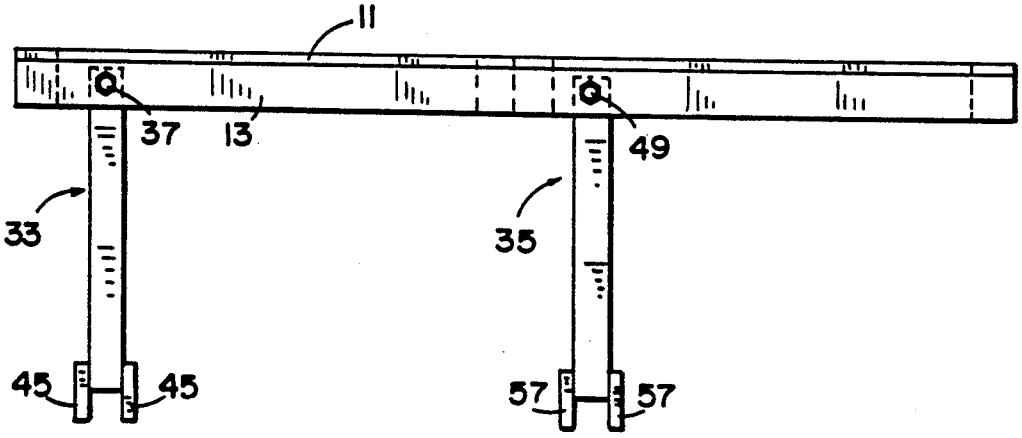
FIG. 2 is a top plan view of the swimming pool panel showing the two deck support members swung out from the panel into their normal working position.

In FIG. 2, a top plan view of the swimming pool wall panel is shown with the deck support members 33 and 35 pivoted outward away from the reinforcing frame 13 and the wall panel 11 into the position they would occupy when in place. It can be seen in FIG. 2 that the gusset plates 45 and 57 extend beyond the deck supports 39 and 51. When the deck supports are in position a stake 71, referring to FIG. 3, is mounted between each of the gusset plates and serves to fix the deck supports 39 and 51 relative to the swimming pool wall panel and also provides a footing for the deck.

Figure 3:
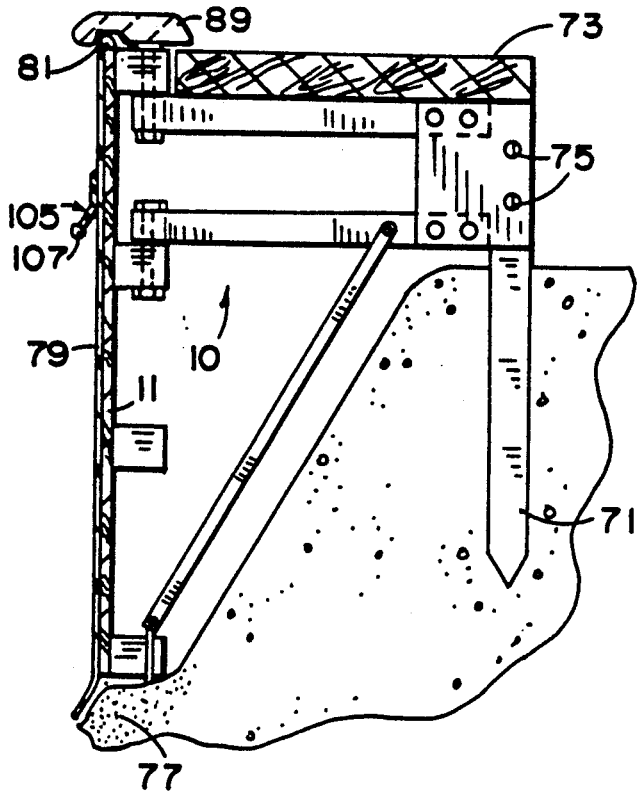
FIG. 3 is a side elevational view partially in section of a swimming pool made using the wall panel of the present invention.

Referring to FIG. 3, which as previously mentioned is a section of a completed swimming pool, the swimming pool wall panel 10 is shown in position with the stake 71 embedded in the ground. In assembling the swimming pool, the portion of which is shown in FIG. 3, an excavation is first made to remove dirt or soil from the area to be occupied by the pool. An oversized excavation is made so that the swimming pool wall panels 10 can be put in place and joined together to form whatever configuration swimming pool is desired. The deck supports are then swung out from the wall panels and the stake 71 is put in place to support the panel 11 in a vertical position and to provide a footing for the decking 73 which is applied around the edge of the completed swimming pool. The stake 71 is, as previously mentioned in the discussion of FIG. 2, fitted into the opening between the gusset plates. The wall panel 11 is properly aligned and stake 71 is then fastened to the gusset plates by suitable fasteners 75, such as nuts and bolts or screws, of a type that will not decompose when wet or when buried in the ground. When all of the deck supporting members and stakes and braces are finally in position, dirt can be back filled about the swimming pool before the deck 73 is applied. All of the aforementioned pieces will then be buried under the ground where they will be out of sight. After all of the back filling, leveling and compaction has taken place, the deck member 73 can be applied about the edge of the swimming pool.

Deck 73 can be of any conventional construction. It is most preferably a wooden deck, but can be a fiberglass reinforced plastic, structural foam plastic or even concrete. Indeed, deck 73 could be preformed concrete members.

Only a portion of a completed swimming pool is shown in FIG. 3 since the remainder of the pool would be a repetition of the same structure. The bottom portion of the figure is shortened so as not to show the full bottom of the swimming pool. The bottom of the pool would be lined with soil such as sand 77 before the pool liner 79 is placed into the pool and spread out.

Figure 4:
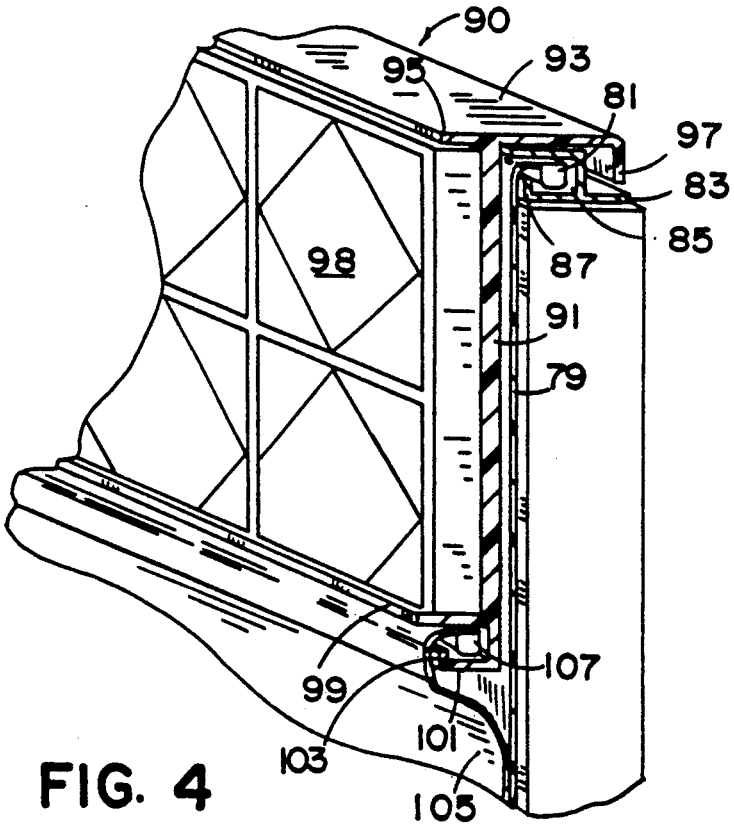
FIG. 4 is a partial perspective view of a decorative tile holder for use in the swimming pool of the present invention.

As can be seen in FIGS. 3 and 4, the pool liner 79 has a bead 81 about its edge. The bead 81 is supported in and held by a pool liner support 83, which can be a piece of extruded aluminum, which is fastened along the upper reinforcing surface 13 of the connected pool wall panels. At the edge of the swimming pool, the pool liner support has a substantially box-like configuration 85, with the edge portion thereof 87 turned upwardly, to substantially close the opening into the box-like structure. After the pool liner is in place in the swimming pool, a suitable decorative coping 89 (FIG. 3) can be applied about the edge of the swimming pool.

The swimming pool, as described in FIG. 3, when filled with water would be ready for use. The visible upper portion of the pool liner 79 can be the traditional light blue in color. As mentioned previously, it is common practice in the installation of in-ground swimming pools to apply a tile decorative feature about the upper edge of the pool at the water line thereof. The tile substantially enhances the appearance of the pool. In accordance with the present invention, the same effect can be accomplished by applying a decorative tile or trim panel indicated generally by the number 90 about the upper edge of the swimming pool. As shown in FIG. 4, the decorative panel 90 comprises tile holders including a substantially flat back panel member 91 and a T-shaped upper portion 93. The forward side of the T 95 is shortened and is used to provide support for the decorative tile piece 98. Tile 98 can be conventional ceramic tile or a molded plastic strip simulating one or more tiles secured to back panel 91 by a suitable adhesive.

The back side of the T is turned downward at 97 to form a hanger for the decorative panel 90 so that it can be supported along and about the top edge of the swimming pool. In order to prevent the bottom edge of the decorative panel from moving with the movement of the water in the swimming pool, a substantially channel-shaped area is formed having upper sides 99 for supporting the bottom of the tile panel 98 and a lower side portion 101, the remote edge of which 103 is turned upwardly to substantially close off the channel between the sides 99 and 101.

Referring back to FIG. 3, the swimming pool liner 79 has a depending flap 105 with a bead 107 formed or attached to the surface of the liner. The flap 105 can be added to the liner when it is made by thermowelding or heat sealing to position the flap substantially parallel to, and spaced from the bead 81, at the edge of the liner. It is also within the scope of the present invention that the flap 105 can be an add-on for existing swimming pools where it would be applied to the already installed swimming pool liner by a suitable waterproof adhesive.

Referring again to FIG. 4, the flap 105 is turned upwardly and is inserted along with the bead 107 into the channel at the bottom of the decorative holder 90. The flap 105 and bead 107 effectively prevent water from sloshing up behind the decorative panel which would cause the panel to move and to wear against the pool liner 79. The decorative tile holder 90 can be made of extruded or vacuum-formed plastic, or even of individual pieces of plastic or metal, which are joined together by conventional fabrication techniques.

Figure 5:
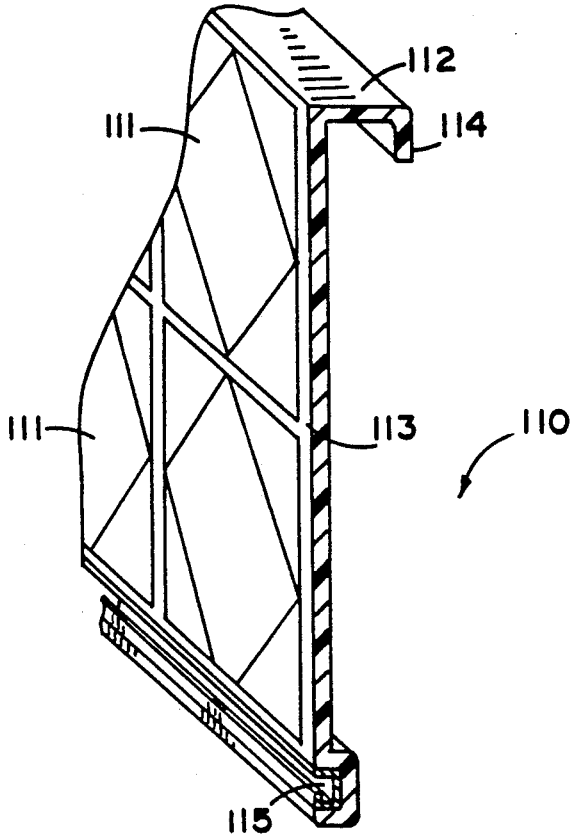
FIG. 5 is a second embodiment of the decorative tile holder.

In FIG. 5, a second embodiment of the decorative tile or trim panel 110 can be made through an injection molding, extrusion or vacuum molding process with the decorative tile patterns 111 being integrally formed in or applied on the surface 113 of the finished part by painting, using suitable stencils or by silk screen printing techniques. Where the tile pattern is painted on, a coating would then be applied over the surface to protect it from the water and the chlorine and other type chemicals used in the swimming pool. The top surface 112 of the trim panel extends back away from the panel and has the edge 114 turned down to form a hanger for said panel. The lower edge of the panel has an integral channel 115 for receiving and holding the flap 105 and bead 107 to keep the panel from moving.

Figure 6:
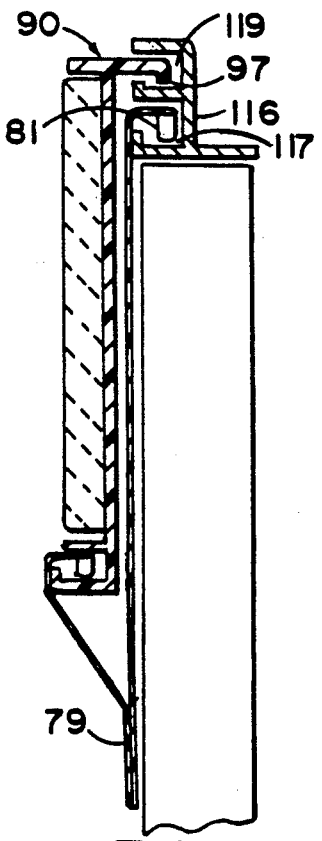
FIG. 6 is a sectional view showing the decorative tile holder and pool liner supported by a second embodiment of the pool liner support.

Referring to FIG. 6, a decorative tile holder 90 is shown supported in a pool liner support 116 which has two vertically spaced tracks or channels. The lower channel 117 supports the bead 81 along the edge of the pool liner 79. The upper channel 119 supports the turned-down edge portion 97 of the decorative tile support 90. Pool liner support 116 is preferred over the support 83 shown in FIG. 4 since the latter support requires the removal of the decorative coping 89 before the pool liner can be replaced.

Figure 7:
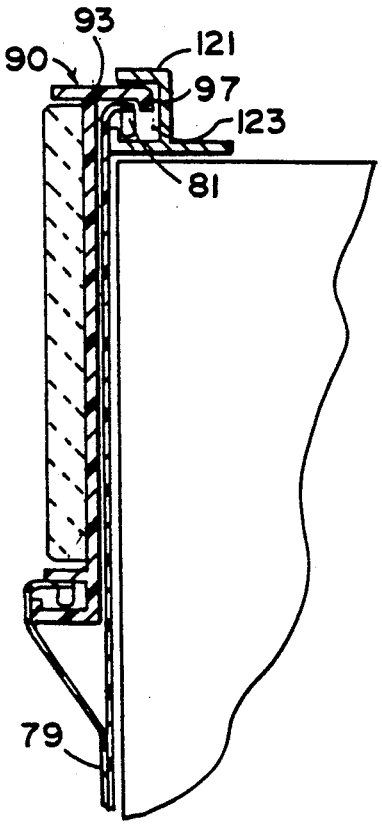
FIG. 7 is a sectional view showing the decorative tile holder supported along with the pool liner within the same track of the pool liner support.

The decorative tile support 90 can be added to an existing pool as shown in FIG. 7. In this type of swimming pool the bead 81 along the edge of the pool liner 79 is supported in the pool liner support 121 which has only a single track 123. The top edge portion 93 of the decorative tile support 90 is placed into the single track 123 on top of the pool liner 79 with the turned-down edge portion 97 behind the bead 81. The decorative tile support 90 can be added to the swimming pool using the existing pool liner support.

It can be seen from the above description that an improved swimming pool construction is disclosed in which many different closed shaped swimming pools can be assembled using the prefabricated wall panels. Decorative features can also be added to the pool to simulate an in-ground swimming pool.

Though the invention has been described with respect to a specific preferred embodiment thereof, many variations and modifications will become apparent to those skilled in the art. It is therefore the intention that the appended claims be interpreted as broadly as possible in view of the prior art to include all such variations and modifications.

The embodiments of the invention in which an exclusive property or privilege is claimed are defined as follows.

1. A swimming pool wall panel assembly comprising:

a wall panel;

a deck support pivotally mounted on said wall panel, said deck support being adapted to pivot between a position against said wall panel and an open deck supporting position projecting away from said wall panel;

a brace pivotally mounted on said wall panel and adapted to be connected to said deck support when said deck support is moved into position to support a deck, said brace pivoting on both a vertical axis and a horizontal axis when said wall panel is positioned to provide a vertical pool wall; and said deck support including means for receiving a ground stake for holding said deck support when in position to support a deck.

2. A swimming pool as set forth in claim 1 wherein a deck is supported about said swimming pool on said deck supports.

3. A swimming pool as set forth in claim 1 wherein a stake is attached to the free end of said deck support to hold it in position and to provide support for said pool wall panel.

4. A swimming pool panel assembly as set forth in claim 1 wherein said wall panel includes reinforcing frame means comprising:

horizontal frame members extending across the top and bottom edges of said wall panel and vertical frame members extending along the vertical edges of said wall panel and joining said horizontal frame members, a centrally disposed vertical frame member joining the horizontal frame member at the top and bottom of said wall panel, and at least one horizontal frame member positioned between each of said vertical frame members and said centrally disposed vertical frame member.

5. A swimming pool panel assembly as set forth in claim 4 wherein said deck support is pivotally mounted between said top horizontal frame member and said at least one horizontal frame member positioned between said vertical frame member and said centrally disposed vertical frame member.

6. A swimming pool panel assembly as set forth in claim 4 wherein a plurality of deck supports are pivotally mounted on said reinforcing frame.

7. A swimming pool panel assembly as set forth in claim 4 wherein said deck support has a pair of spaced parallel arms which are pivotally mounted on said reinforcing frame and which are joined together at their remote ends by at least one gusset plate.

8. A swimming pool panel assembly as set forth in claim 7 wherein a ground stake is attached to said at least one gusset plate when said deck support is in its deck supporting position.

9. A swimming pool wall panel assembly comprising;

a wall panel;

a reinforcing frame about the edges on one surface of said wall panel, said frame comprising horizontal frame members extending across the top and bottom edges of said wall panel and vertical frame members extending along the vertical edges of said wall panel and joining said horizontal frame member, a centrally disposed vertical frame member joining the horizontal frame member at the top and bottom of said wall panel, and at least one horizontal frame member positioned between each of said vertical frame members and said centrally disposed vertical frame member;

a deck support pivotally attached to the reinforcing frame on the back of said wall panel and being adapted to pivot between a position against said wall panel when not in use and a position extending outwardly from said wall panel to support a deck, said deck support pivoting on an axis substantially parallel to said vertical frame such that said deck support is substantially parallel to said horizontal frame when said deck support is against said panel;

a brace pivotally attached to the horizontal frame member extending across the bottom edge of said wall panel and being adapted to be fastened to said deck support when said deck support is in use; and a ground stake for holding said deck support when in position to support a deck.

10. A decorative tile holder for the edge of a swimming pool comprising:

a panel having a T-shaped upper portion and a channel-shaped lower portion with the upper and lower sides forming said channel being substantially parallel and extending outwardly from said panel;

said T-shaped upper portion having one side of said T for holding decorative tile and the other side of said T having the edge turned down to form a hanger for said decorative tile holder; and said channel-shaped lower portion having an upper side extending outwardly from said panel for supporting decorative tile and the lower side having the edge turned upwardly substantially closing said channel and forming a pool liner bead gripping member.

11. A decorative tile holder as set forth in claim 10 wherein said substantially flat panel, said T-shaped upper portion and said channel-shaped lower portion are all separate pieces joined together.

12. A decorative tile holder as set forth in claim 10 wherein the top of said T-shaped upper portion is off-centered providing a wider side for said hanger for said decorative tile holder.

13. A decorative tile holder as set forth in claim 10 wherein said holder is adapted to support a plurality of tiles along the edge of a swimming pool.

14. A decorative tile holder as set forth in claim 10 wherein water is prevented from getting behind said decorative tile holder when a pool liner bead is held in said pool liner gripping member.

15. A swimming pool comprising a closed wall structure bounding an area which will form the bottom of said swimming pool made up of an assemblage of pool wall panel assemblies, each wall panel assembly comprising:

a wall panel;

a reinforcing frame mounted on one side of said wall panel;

a deck support pivotally mounted on said reinforcing frame, said deck support being adapted to be in a folded position adjacent said reinforcing frame and in an open deck supporting position;

a brace pivotally mounted on said reinforcing frame and adapted to be connected to said deck support when said deck support is moved into position to support a deck;

a ground stake for holding said deck support when in position to support a deck;

a pool liner support fastened about the edge of said closed wall structure;

a flexible pool liner having a bead about the edge thereof said bead being held by said pool liner support, said flexible pool liner covering said closed wall structure and the area forming the bottom of said swimming pool;

a flap of material attached to said flexible pool liner and depending therefrom and having a bead along the edge thereof; and a decorative tile holder supported by said pool liner support and depending into the area covered by said flexible pool liner and having a bead receiving recess adjacent the cover edge thereof for receiving and having the lower edge held by said bead and flap of material attached to said flexible pool liner and decorative tile supported in said tile holder about the edge of said swimming pool.

16. A swimming pool as set forth in claim 15 wherein said brace is attached to said deck support.

17. A swimming pool as set forth in claim 15 wherein said flap of material is attached to said flexible pool liner substantially parallel to the bead about the edge of said pool liner.

18. A swimming pool as set forth in claim 15 wherein said flap is a folded over portion of said flexible pool liner having a bead along the free edge thereof.

19. A swimming pool as set forth in claim 15 wherein said decorative tile holder is a substantially flat panel having a T-shaped upper edge with one side of the T supporting decorative tile while the other edge of the T has the remote edge bent downwardly to grip said pool liner support and the lower edge has a substantially closed channel configuration for receiving and holding said bead on said flap of material and the bottom edge of said decorative tile.

20. A decorative trim panel for use in a swimming pool comprising:

an elongated panel having a top portion turned back away from the front surface and with the edge turned down to form a hanger for said panel; and an elongated channel extending along the bottom edge of said channel for receiving and holding a flap and bead to prevent said decorative panel from moving by water motion.

21. A swimming pool comprising:

a plurality of wall panels assembled to define the pool perimeter, each wall panel including an upper edge;

a flexible liner having a top edge secured to said wall panels generally at said upper edge thereof;

said flexible liner including a short flexible flap projecting therefrom at a point spaced a short distance below said top edge thereof;

a decorative trim panel being secured to said upper edge of said wall panel over said top edge of said flexible liner and extending downwardly over a portion of said flexible liner to a bottom edge located adjacent said short flexible flap;

said bottom edge of said trim panel and said short flap including means cooperating to secure same together to hold said bottom edge against said flexible liner and prevent water, dirt and algae from getting into the space between said trim panel and said flexible liner.

22. A swimming pool as set forth in claim 21 wherein said decorative trim panel has a T-shaped upper portion with one side of said T holding a decorative panel while the other side of said T has the edge thereof turned down to form a hanger for said decorative trim panel.

23. A swimming pool as set forth in claim 21 wherein said decorative trim panel has an integral hanger portion extending along the top edge thereof for supporting said decorative trim panel.

24. A swimming pool as set forth in claim 21 wherein said decorative trim panel has decorative patterns integrally formed in the surface thereof.

25. A swimming pool as set forth in claim 21 wherein said bottom edge of said decorative trim panel includes a pair of spaced walls extending from said panel forming a channel extending across the bottom of said panel, the upper wall of said pair of spaced walls supporting the bottom of a decorative panel while the lower wall of said pair of spaced walls has the edge turned upwardly closing off a portion of said channel and forming a griping surface for said short flexible flap.

26. A swimming pool as set forth in claim 25 wherein said short flexible flap on said flexible liner has a bead along the free edge thereof for being held within said channel along the lower edge of said decorative trim panel.

27. A swimming pool as set forth in claim 25 wherein said decorative trim panel has a wall member between said T-shaped top portion and said channel extending along the lower portion, said wall member supporting decorative tile adhered thereto.

28. A swimming pool panel assembly as defined in claim 1 wherein said support member has a first end mounted to said wall panel and a second end for attachment to a ground stake, said second end of said support member having an open channel for adjustably receiving said ground stake to enable said support member to be moved relative to said ground stake for the positioning of said swimming pool wall panel and said deck, whereby said ground stake assists in supporting said wall panel.

29. A support for a swimming pool wall panel and deck as set forth in claim 28, wherein said second end of said support member has at least one gusset plate attached thereto and extending therefrom to form said open channel therein.

30. A support for a swimming pool wall panel and deck as set forth in claim 28, wherein said second end of said support member is bifurcated.

31. A support for a swimming pool wall panel and deck as set forth in claim 28, wherein a gusset plate is attached to each side of said second end of said support member to form said open channel therebetween.

32. A support for a swimming pool wall panel and deck as set forth in claim 28, further comprising fastening means for fastening said second end of said support member to said ground stake when said swimming pool wall panel is in position.

* * * * *